US006293807B1

(12) United States Patent
Lok

(10) Patent No.: US 6,293,807 B1
(45) Date of Patent: Sep. 25, 2001

(54) ELECTRICAL CONNECTOR ASSEMBLY

(75) Inventor: Gordon Lok, La Habra, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/541,231

(22) Filed: Apr. 3, 2000

(51) Int. Cl.[7] ..... H01R 12/24
(52) U.S. Cl. ..... 439/67; 439/499
(58) Field of Search ..... 439/67, 77, 499, 439/492

(56) References Cited

U.S. PATENT DOCUMENTS 4,900,269 * 2/1990 Lynch ..... 439/499
5,967,833 * 10/1999 Cachina ..... 439/499

* cited by examiner

*Primary Examiner*—Gary F. Paumen
(74) *Attorney, Agent, or Firm*—Wei Te Chung

(57) ABSTRACT

An electrical connector assembly comprises an elongate holder defining a recessed planar field. A pair of towers extends upward from transverse ends thereof and is located adjacent to the recessed planar field. Side ribs extend inward from the towers defining retaining grooves between the side ribs and the holder. An elongate housing is assembled to the holder, and includes side tabs fixedly retained in the retaining grooves. The elongate housing defines a cutout such that the recessed planar field is accessible through the cutout. A plurality of terminal is integrally formed with the housing and each terminal includes a body portion retained in the housing. A contact portion extends above the housing, and a contact tail extends into the cutout. A flexible flat cable is inserted into a gap defined between the recessed planar field and the housing, and with conductors thereon aligned with the solder tails.

1 Claim, 10 Drawing Sheets

ELECTRICAL CONNECTOR ASSEMBLY

FIELD OF THE INVENTION

The present invention relates to an electrical connector assembly, and more particularly to an electrical connector assembly for use with a palm type device.

DESCRIPTION OF THE PRIOR ART

Palm-top device has been widely accepted by the customers as it features compact and convenience to access information stored therein. However, the palm-top has been designed to become more powerful. For example, the palm-top is to be used as a remote controller to control a notebook during a presentation. In doing so, the palm-top device is assembled to carriage on which controlling circuitry is arranged. The carriage includes upper and lower covers hinged together. One of the covers is provided with a connector on which the palm-top device is electrically seated.

The existing configuration of the connector requires a lot of assembly process and components and which inevitably increase the cost.

SUMMARY OF THE INVENTION

It is an objective of this invention to provide an electrical connector assembly which can be used to electrically connect a palm-top to a carriage such that the palm-top can be used as a remote controller.

In order to achieve the objective set forth, an electrical connector assembly in accordance with the present invention comprises an elongate holder defining a recessed planar field. A pair of towers extends upward from transverse ends thereof and is located adjacent to the recessed planar field. Side ribs extend inward from the towers defining retaining grooves between the side ribs and the holder. An elongate housing is assembled to the holder, and includes side tabs fixedly retained in the retaining grooves. The elongate housing defines a cutout such that the recessed planar field is accessible through the cutout. A plurality of terminal is integrally formed with the housing and each terminal includes a body portion retained in the housing. A contact portion extends above the housing, and a contact tail extends into the cutout. A flexible flat cable is inserted into a gap defined between the recessed planar field and the housing, and with conductors thereon aligned with the solder tails.

These and additional objects, features, and advantages of the present invention will become apparent after reading the following detailed description of the preferred embodiments of the invention taken in conjunction with the appended drawings.

DETAILED DESCRIPTION OF PREFERRED EMBODIMENT

Figure 1:
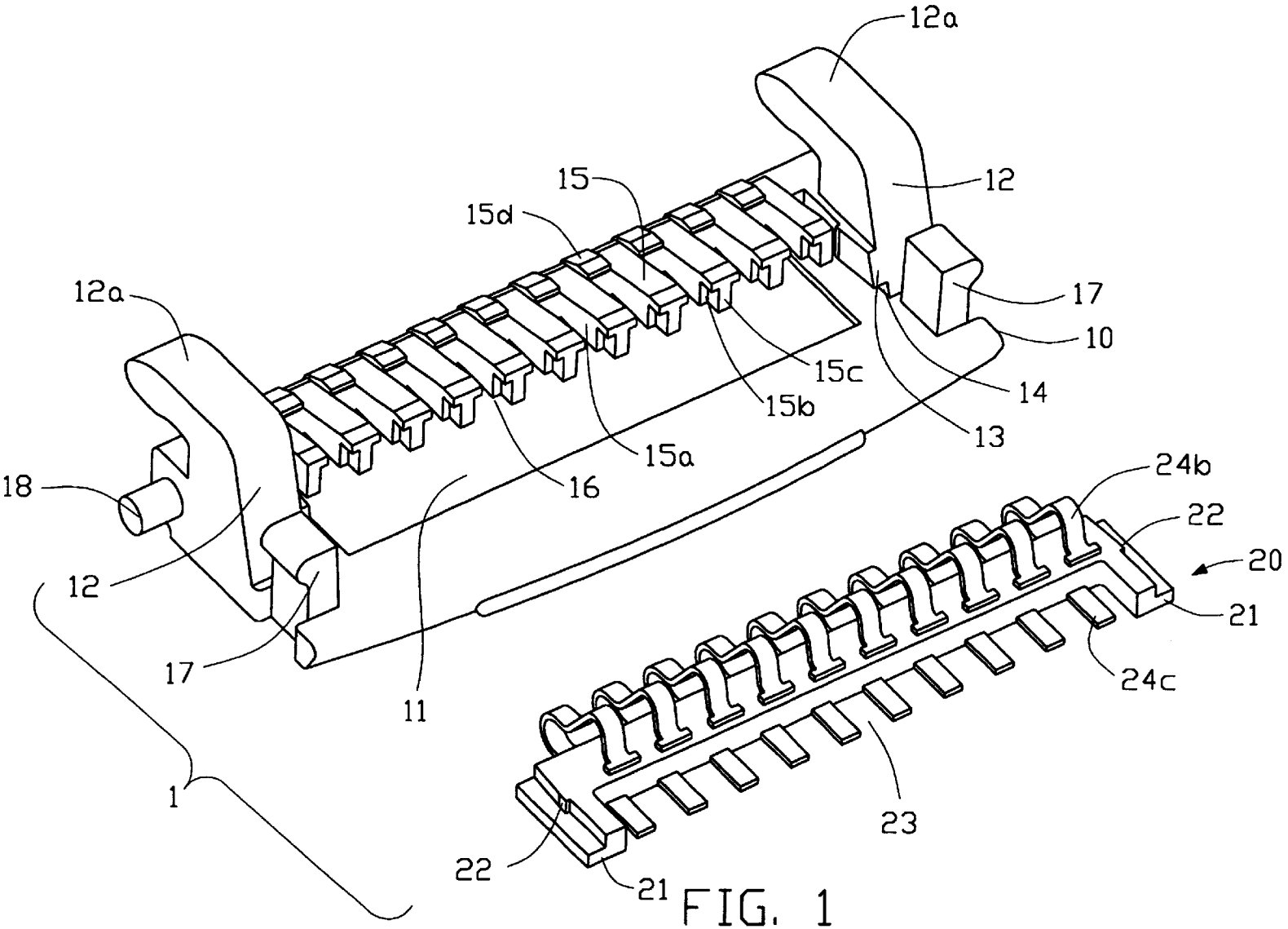
FIG. 1 is an exploded view of an electrical connector assembly in accordance with the present invention.
Figure 2:
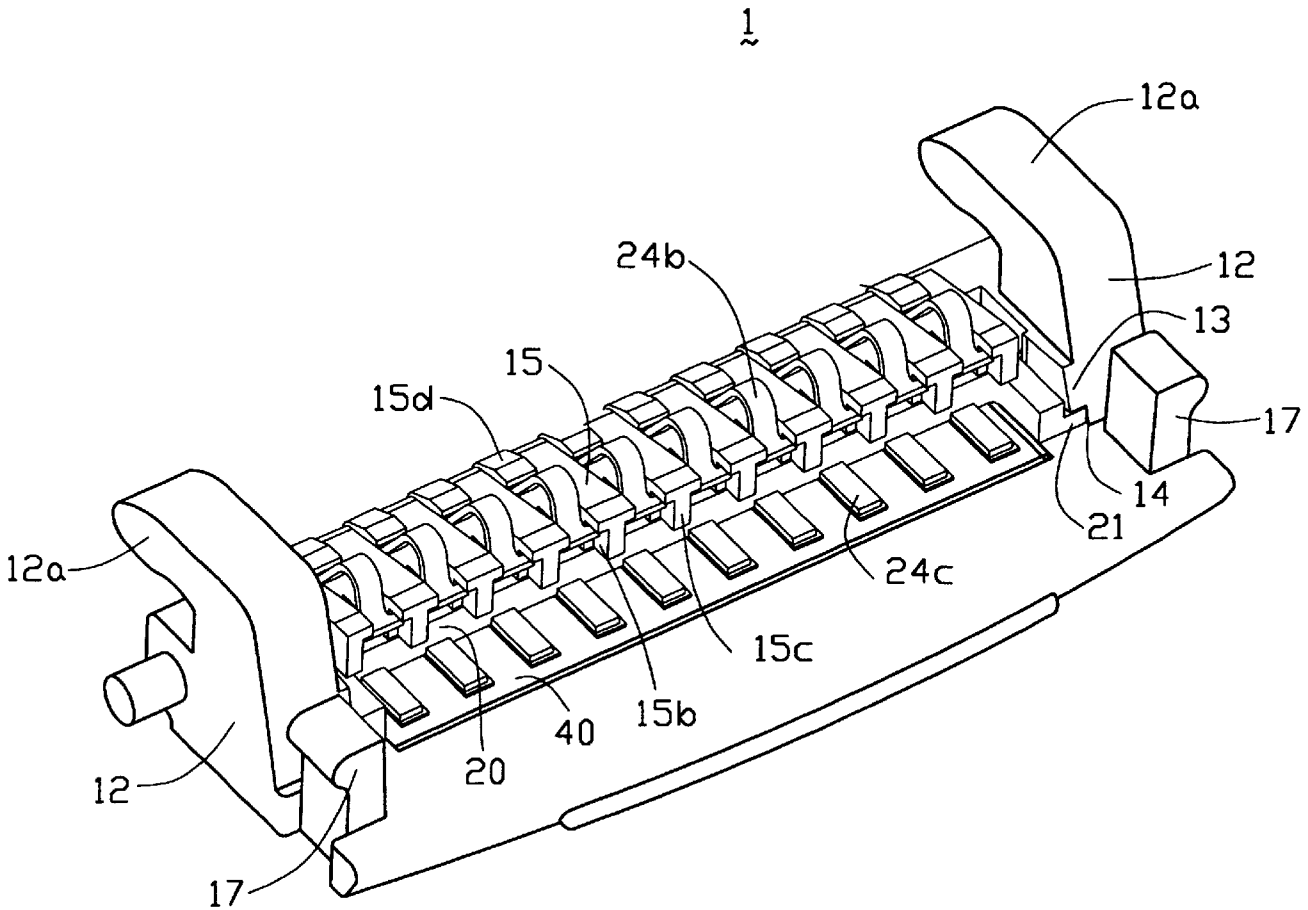
FIG. 2 is an assembled view of FIG. 1.

Referring to FIGS. 1 to 8, an electrical connector assembly 1 in accordance with the present invention comprises an elongate holder 10 defining a recessed planar field 11. A pair of towers 12 extends upward from transverse ends thereof and located adjacent to the recessed planar field 11. Side ribs 13 extend inward from the towers 12 defining retaining grooves 14 between the side ribs 13 and the holder 10. The elongate holder 10 further includes a plurality of partition blocks 15 defining a plurality of cells 15*a* between two adjacent partition blocks 15. Each block 15 includes recessed portions 15*b* at front end 15*c*. Each cell 15*a* is further formed with a retaining plate 15*d*. Each tower 12 further includes an engaging rod 12*a* extending horizontally from a top portion thereof. A gap 16 is defined under the partition blocks 15 thereby providing an entry for a flexible printed cable 40. The holder 10 further includes a pair of hooks 17 for fixedly engaging locks 72 of a lower cover 61 of a carriage 70. A pair of shafts 18 is formed on the holder 10.

Figure 3:
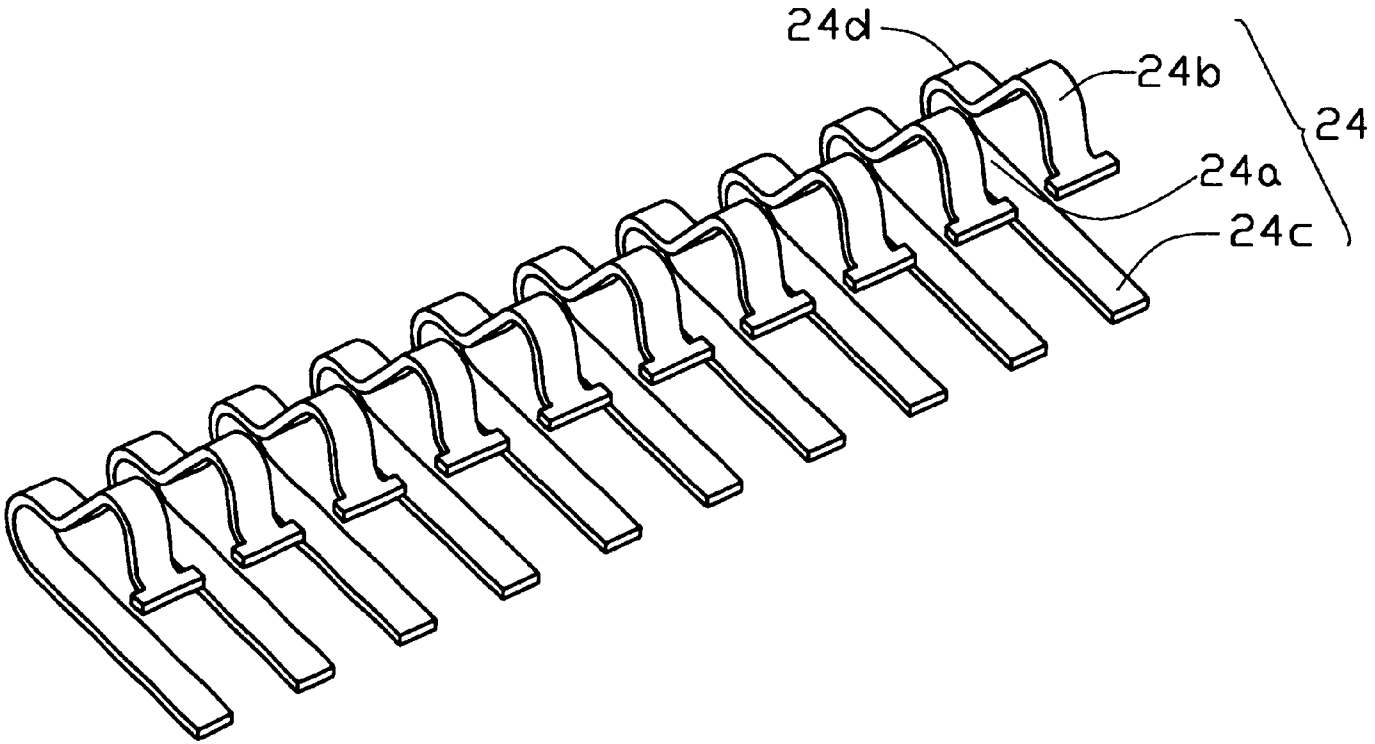
FIG. 3 is a perspective view of a plurality of terminals before insert-molding process.
Figure 4:
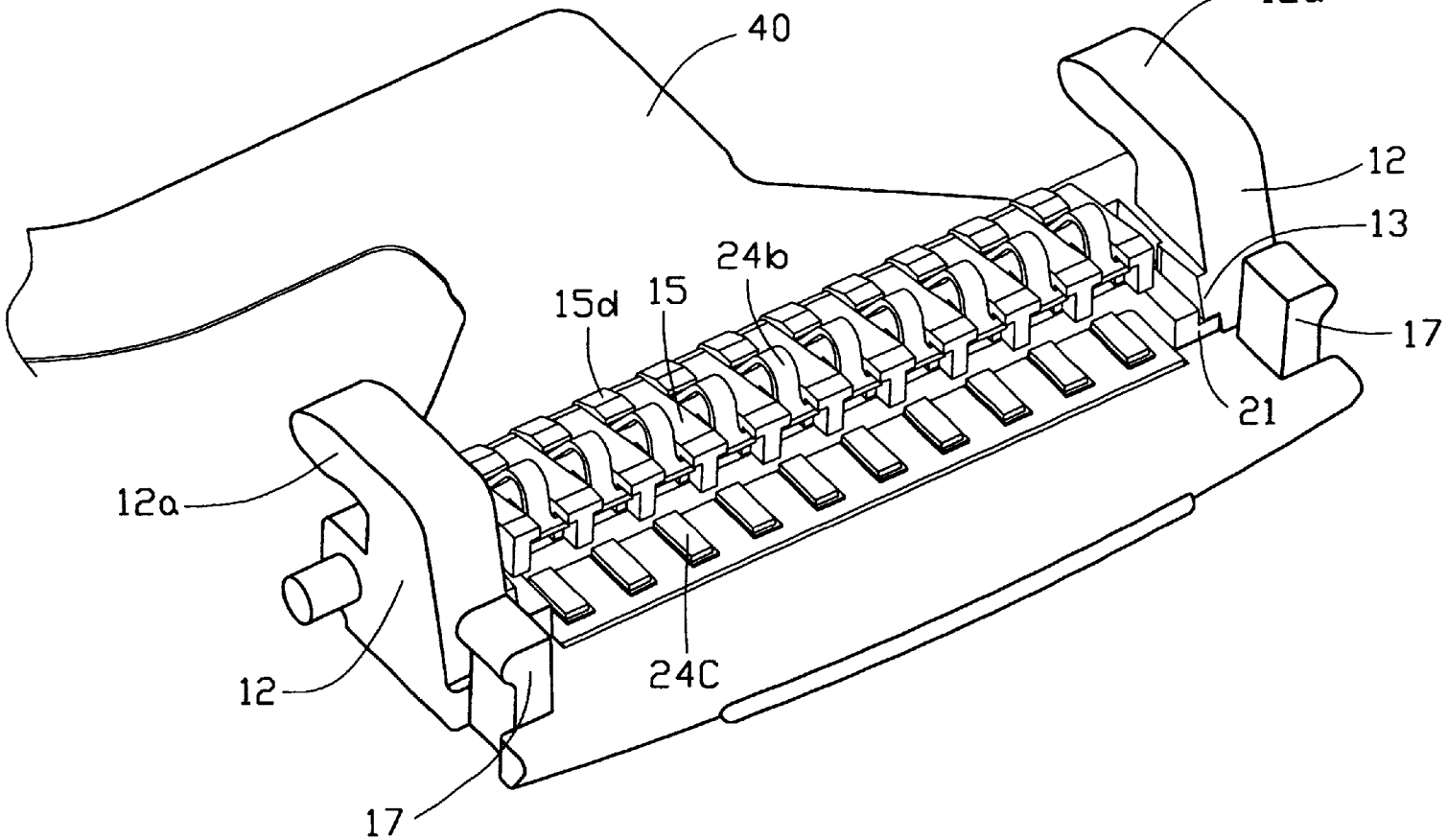
FIG. 4 is a perspective view of an assembled view of FIG. 1 with a flat flexible cable assembled therein.
Figure 5:
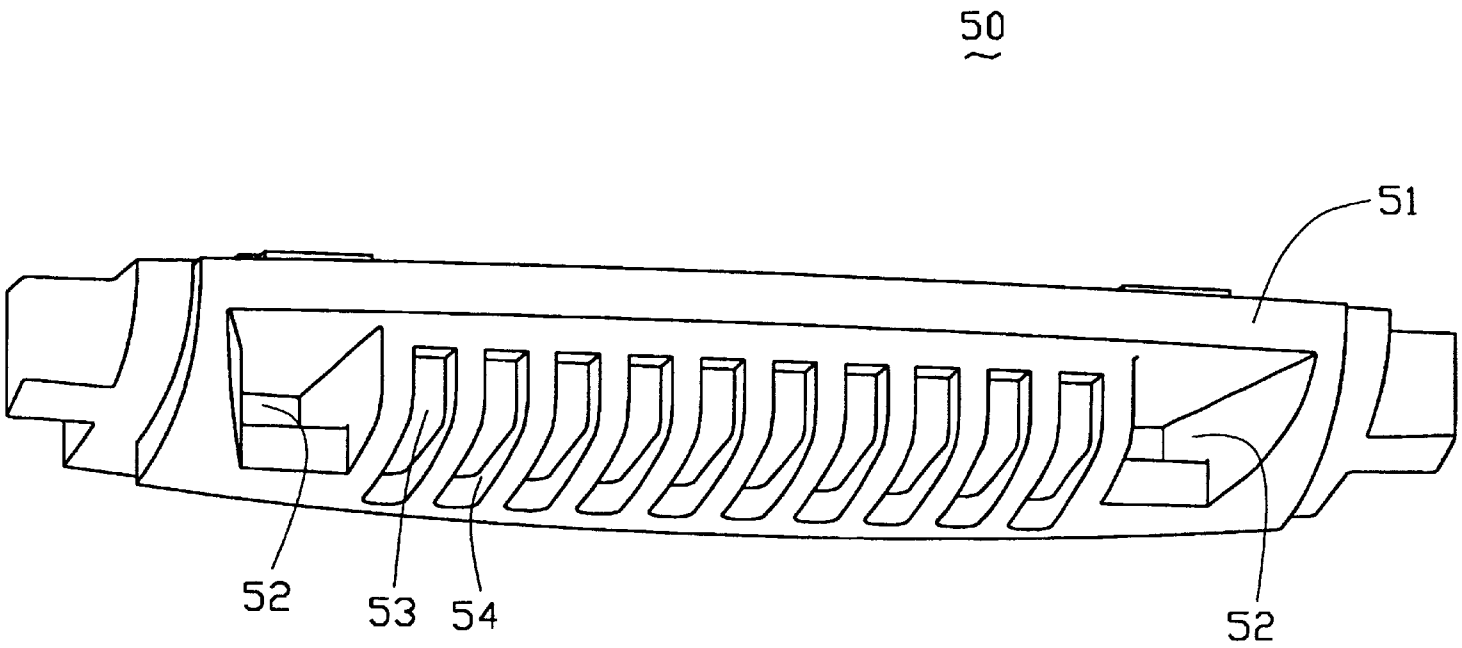
FIG. 5 is cross sectional view showing the connector of FIG. 1 is engaged with a complementary connector of a palm-top device.

Referring to FIGS. 1 and 3, a plurality of terminals 24 are integrally formed with an elongate housing 20 which includes side tabs 21 fixedly retained in the retaining grooves 14. The housing 20 further includes retaining buds 22 for fixedly engaging with the holder 10. The housing 20 defines a cutout 23 between the two side tabs 21 such that the recessed planar field 11 is accessible through the cutout 23 and solder tails 24*c* of the terminals 24 are also exposed. Each terminal 24 includes a body portion 24*a* retained in the housing 20, a contact portion 24*b* extending above the housing 20, and a contact tail 24*c* extending into the cutout 23. The contact portion 24*b* are formed after the terminals 24 are integrally formed with the housing 20. When the housing 20 is assembled to the holder 10, the gap 16 then extends under the housing 20.

A flexible flat cable 40 is inserted into a gap 16 defined between the recessed planar field 11 and the partitioning blocks 15. Conductors (not labeled) of the flexible flap cable 40 are each aligned with the solder tail 24*c* of the terminals 24. Then the solder tails 24*c* and the conductors can be soldered together.

Figure 7:
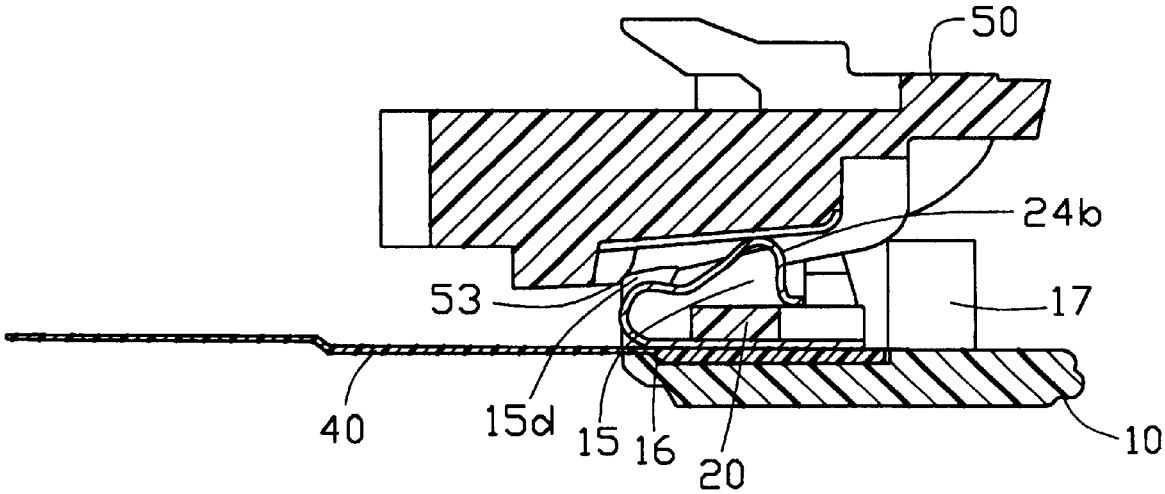
FIG. 7 is a perspective view of the complementary connector used in the palm-top device.

Referring to FIG. 7, a complimentary connector 50 which is built on the palm-top computer, generally includes a housing 51 with two engaging recesses 52 defined therein. Terminals 53 are formed with the housing 51 with each terminal 53 accessible through slots 54.

Figure 6:
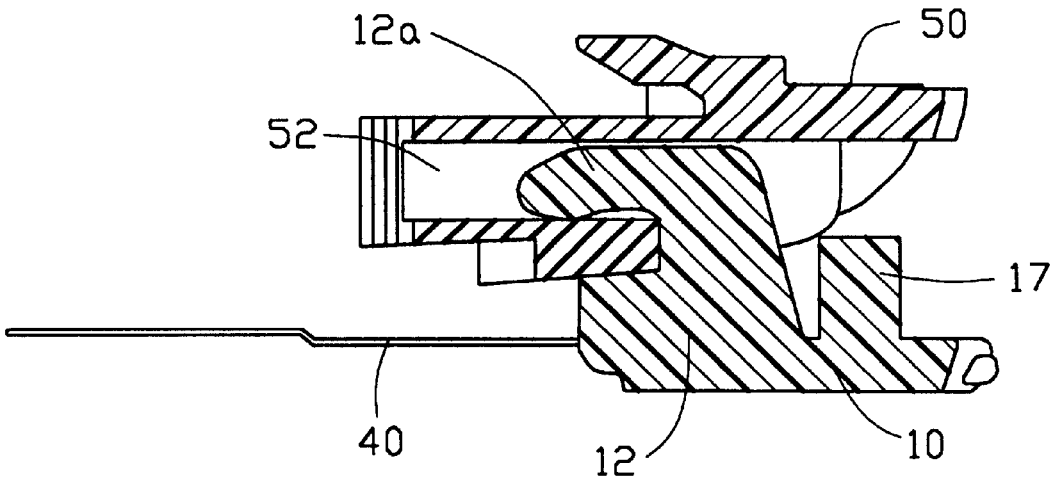
FIG. 6 is a cross sectional view showing the connector of FIG. 1 is electrical connected with the complementary connector of the palm-top device.

Referring to FIGS. 6 and 7, when the complimentary connector 50 is engaged with the electrical connector assembly 1 in accordance with the present invention, the engaging rods 12*a* of the holder 10 are fixedly engaged with the retaining recesses 52, while the terminal 53 are electrically engaged with the contact portion 24*b* of the terminal 24.

Referring to FIGS. 8, 8(A), 9 and 10, the carriage 70 includes upper and lower covers and only lower cover 70 is shown for simplicity. The upper and lower covers are hinged together such that the palm-top computer (not shown) mounted on a liner 79 which is also pivotable along the same spindle with the lower cover 70, can be enclosed therein. The lower cover 71 includes an opening 71*a* in compliance with the dimension of the connector assembly 1, and a pair of sockets 71*b* is arranged adjacent to the opening 71. The lower cover 71 further includes a pair of lock 72 adjacent the opening 71*a*.

Figure 8:
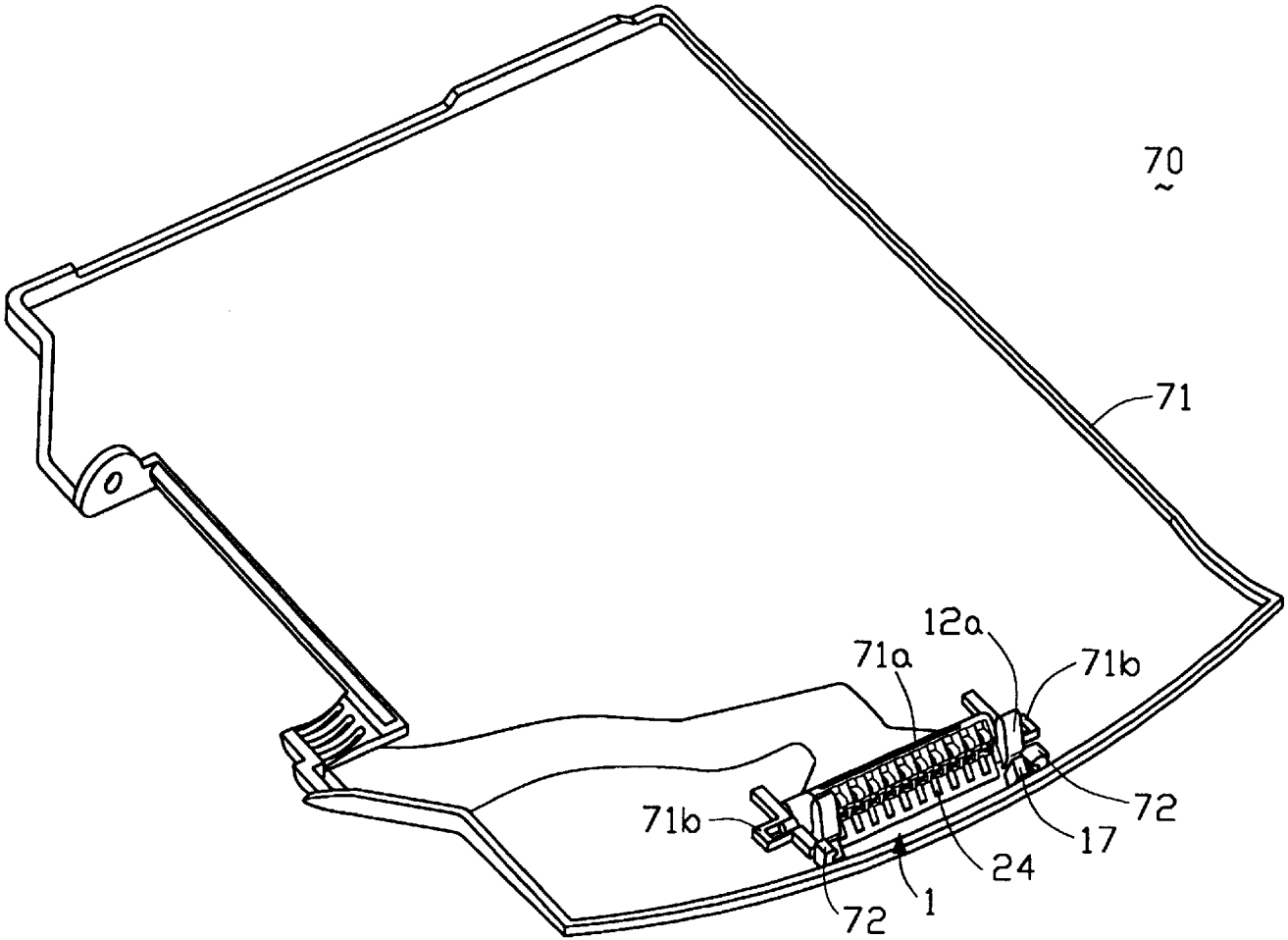
FIG. 8 is a perspective view showing the connector is pivotally assembled to a lower cover of a carriage.
Figure 8A:
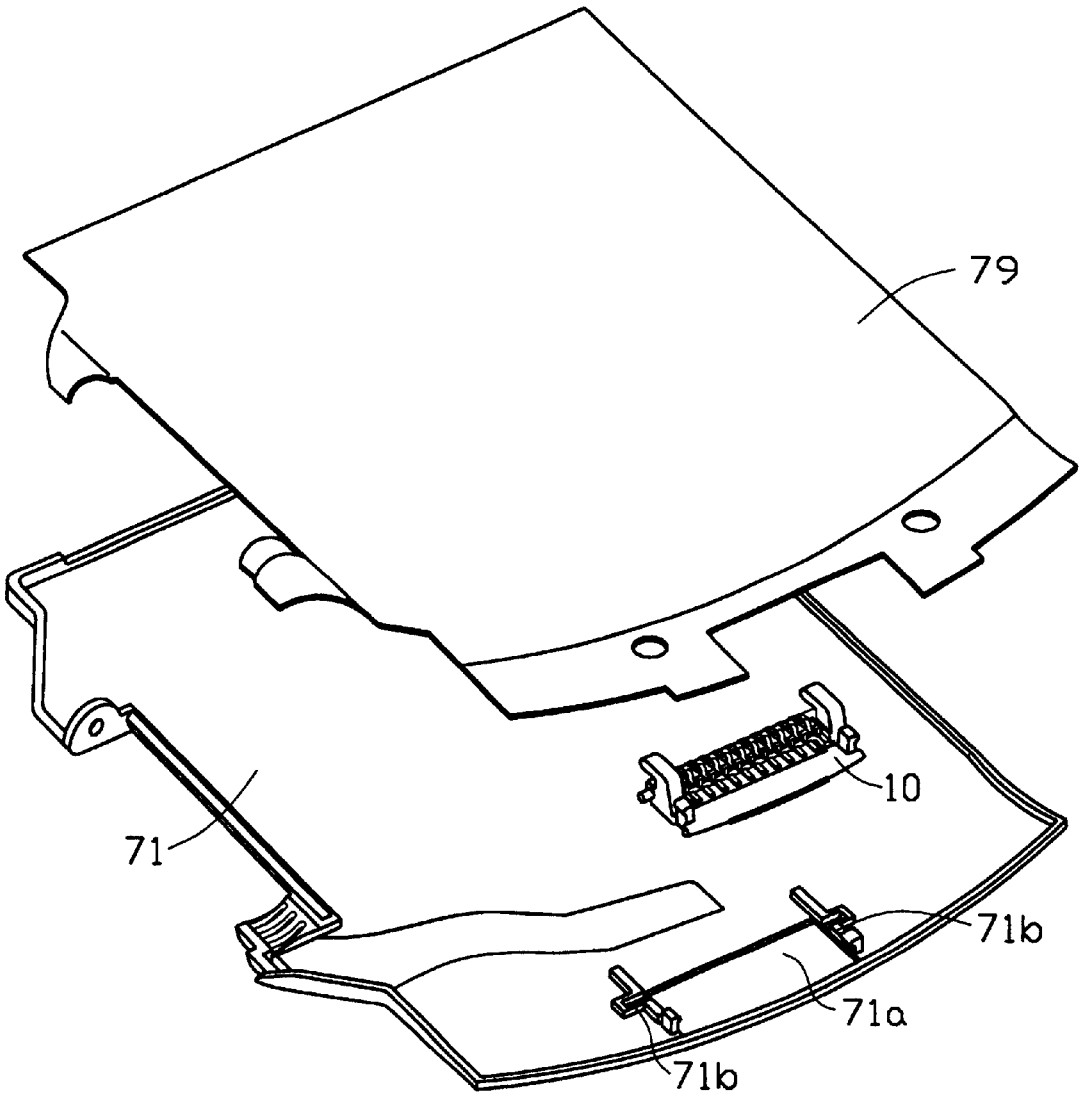
FIG. 8(A) is an exploded perspective view showing the pivotable liner, the pivotable lower cover with an opening, and the connector assembly being ready to swing in the opening.
Figure 9:
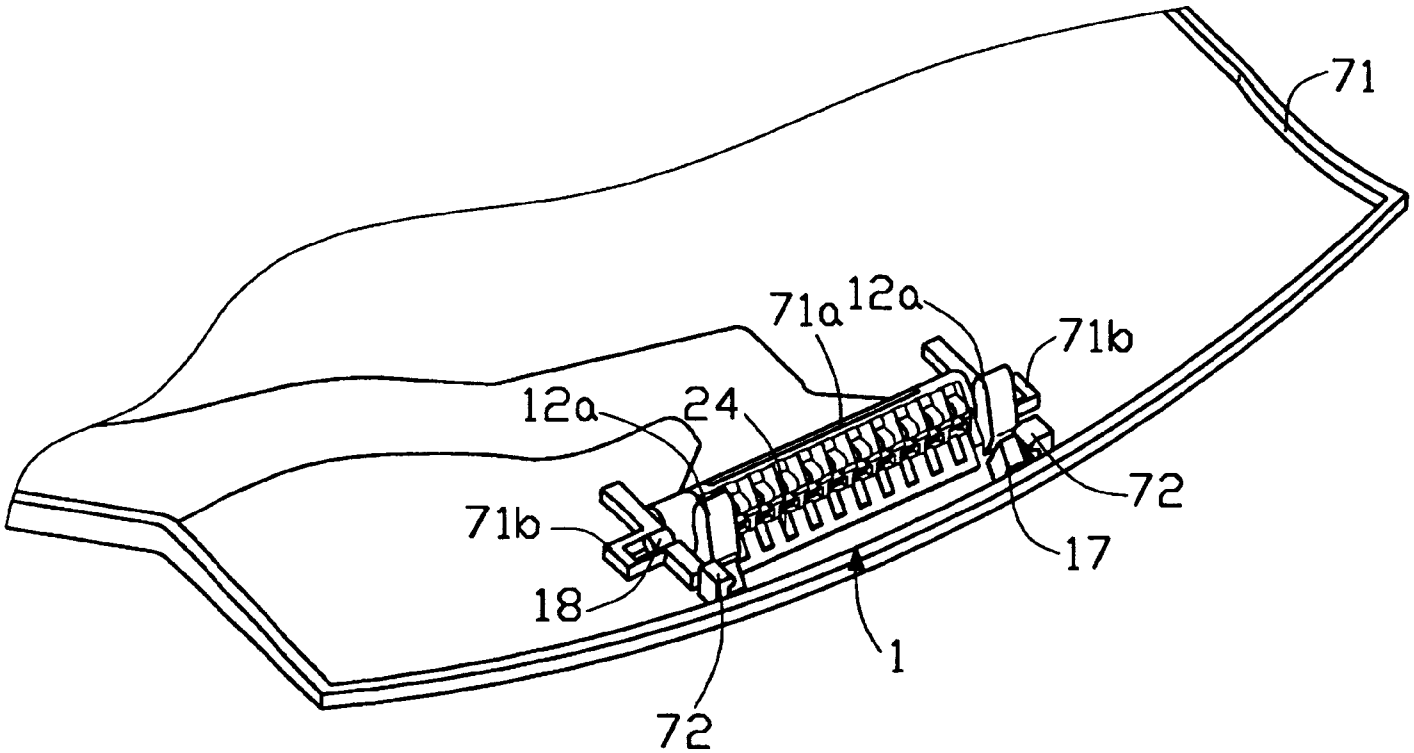
FIG. 9 is a partial view showing the connector is located in a unlatched position.
Figure 10:
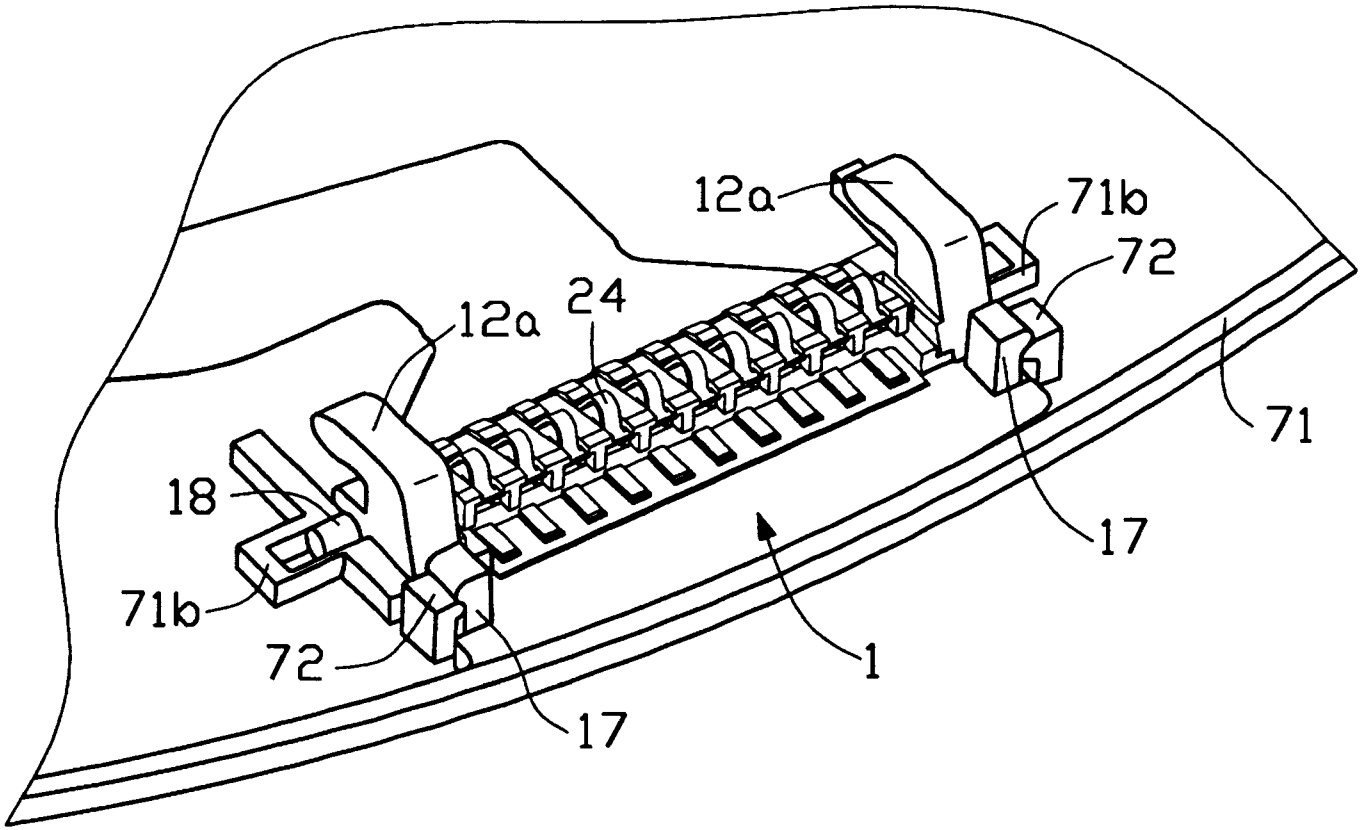
FIG. 10 is a still a partial view showing the connector is rotated to a latched position.

In assembling, the shaft 18 of the holder 10 can be rotationally retainably received within the sockets 71*b* such that the connector assembly 1 can be positioned in an unlatched position, as shown in FIGS. 8 and 9, when no palm-top computer is mounted unto the liner 79, while being rotated about the shaft 18, via upward finger operation through the opening 71*a,* to be in a latched position as shown in FIG. 10 when the palm-top computer with the associated liner 79 is rotated about the spindle to be positioned on the lower cover 71. In the latched position, the hooks 17 of the holder 10 will be fixedly interlocked with the locks 72. Meanwhile, the engaging rods 12*a* of the holder 10 are fixedly engaged with the retaining recesses 52, as clearly shown in FIG. 6. By this retainable arrangement, the palm-top computer with the associated liner 79 can be fixedly disposed upon the lower cover 71.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical connector assembly, comprising:

an elongate holder defining a recessed planar field, a pair of towers extending upward from transverse ends thereof and located adjacent to said recessed planar field, side ribs extending inward from said towers defining retaining grooves between said side ribs and said holder an elongate housing assembled to said holder, and including side tabs fixedly retained in said retaining grooves, said elongate housing defining a cutout such that said recessed planar field is accessible through said cutout;

a plurality of terminals embedded in with said housing, each terminal including a body portion retained in said housing, a contact portion extending above said housing, and a contact tail extending into said cutout; and a flexible flat cable inserted into a gap defined between said recessed planar field and said housing, and with conductors thereon soldered to said solder tails;

wherein a tip of said contacting portion of said terminal abuts against a top portion of said elongate housing when said terminal engages a complementary terminal;

wherein said elongate holder includes a plurality of cells each aligned with a corresponding terminal;

wherein said contact portion of each terminal extends beyond the respective cell of said holder;

wherein each tower includes an engaging rod extending from a top thereof.

* * * * *